US006234041B1

(12) United States Patent
Larabet et al.

(10) Patent No.: US 6,234,041 B1
(45) Date of Patent: May 22, 2001

(54) COMBINED CUSHION AND SEAL FOR VEHICULAR DOOR HANDLE ASSEMBLY

(75) Inventors: James Larabet, Newaygo; Michael Boorsma, Grandville, both of MI (US)

(73) Assignee: ADAC Plastics, Inc., Grand Rapids, MI (US)

( * ) Notice: Subject to any disclaimer, the term of this patent is extended or adjusted under 35 U.S.C. 154(b) by 0 days.

(21) Appl. No.: 09/379,041

(22) Filed: Aug. 23, 1999

(51) Int. Cl.[7] ..... E05B 3/00
(52) U.S. Cl. ..... 74/523; 74/543
(58) Field of Search ..... 74/523, 543; 277/916, 277/648, 644, 630; 296/146.1, 146.5; 292/336.3

(56) References Cited

U.S. PATENT DOCUMENTS

| | | | | |
|---|---|---|---|---|
| 3,789,550 | | 2/1974 | Seiwert . | |
| 3,993,338 | | 11/1976 | Cherbourg et al. . | |
| 4,475,754 | | 10/1984 | Arlauskas et al. . | |
| 4,482,179 | | 11/1984 | Johnson . | |
| 4,511,172 | | 4/1985 | Tabata et al. . | |
| 5,092,642 | * | 3/1992 | Lindmayer et al. | 292/336.3 |
| 5,352,004 | * | 10/1994 | Nedbal | 292/347 |
| 5,671,927 | * | 9/1997 | Schweiger | 277/9 |
| 6,042,159 | * | 3/2000 | Spitzley et al. | 292/216 |
| 6,059,329 | * | 5/2000 | Spitzley | 292/336.3 |
| 6,070,923 | * | 6/2000 | Tanimoto et al. | 292/336.3 |

* cited by examiner

*Primary Examiner*—David A. Bucci
*Assistant Examiner*—Vicky A. Johnson
(74) *Attorney, Agent, or Firm*—Young & Basile, P.C.

(57) ABSTRACT

An outside door handle assembly for a motor vehicle. The handle assembly includes a housing mounted in the door and a handle having a grip portion and an arm portion extending inwardly from one end of the handle for passage through an opening in the handle for coaction with a latch release mechanism positioned within the door. An annular resilient member is mounted on the arm portion proximate the juncture of the arm portion and the grip portion. The resilient member includes a plurality of cushion portions which project inwardly from the inner surface of the resilient member to cushion the impact of the handle with the housing as the handle moves to its closed position and the resilient member further includes an annular peripheral seal portion projecting inwardly from the inner surface of the resilient member in surrounding relation to the cushion portions and movable into sealing coaction with the housing to preclude the entry of moisture and contaminants into the interior of the door with the handle in its closed position.

16 Claims, 4 Drawing Sheets

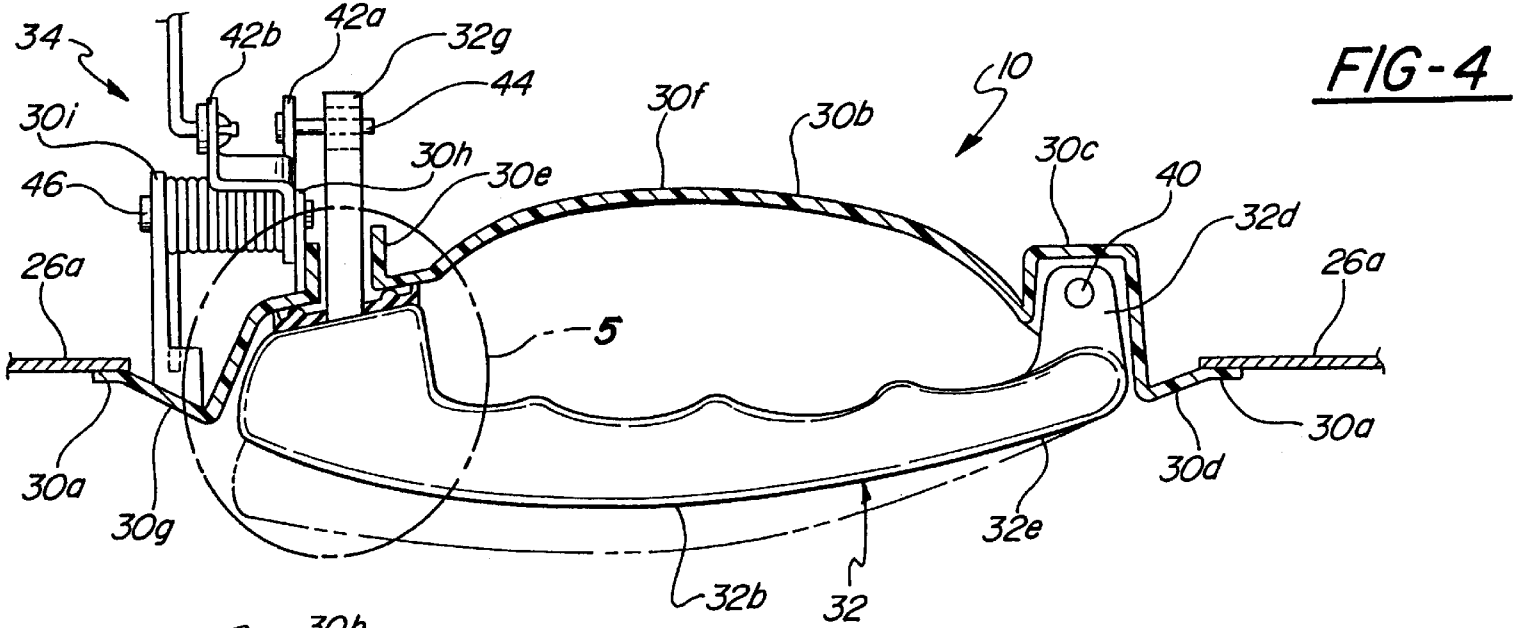
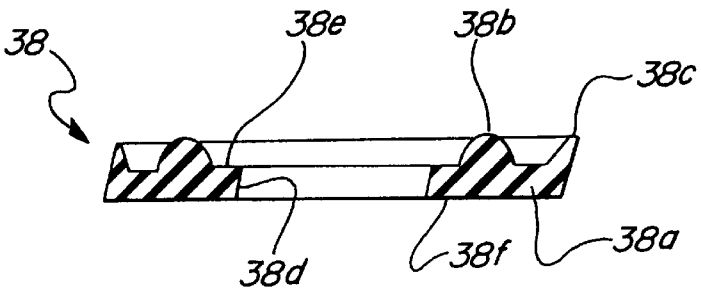
FIG-6
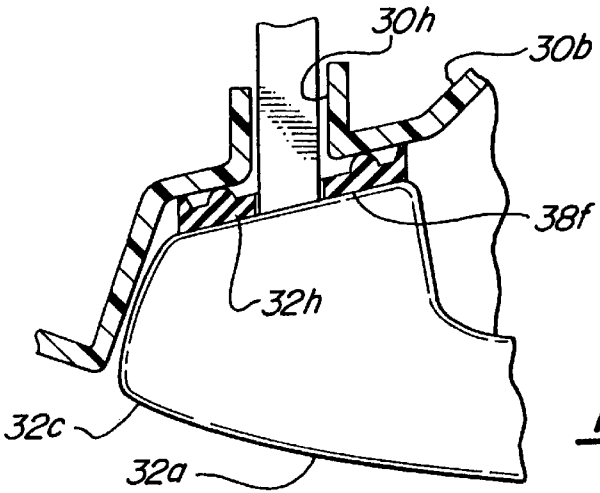
FIG-5

COMBINED CUSHION AND SEAL FOR VEHICULAR DOOR HANDLE ASSEMBLY

BACKGROUND OF THE INVENTION

This invention relates to door handle assemblies and, more particularly, to door handle assemblies especially suitable for use on motor vehicles. Motor vehicle door handle assemblies typically include a handle member which is movable between open and closed positions to provide latching and unlatching of the door. The door handle assembly typically includes a spring member which provides moderate resistance to opening movement of the handle and ensures that the handle will move firmly and positively to its closed position upon release of the handle. However, the firm positive movement of the door handle assembly to its closed position will, without some cushioning provision, generate an annoying slapping noise which detracts from the feeling of overall quality with respect to the door handle assembly and which may contribute to ultimate damage to the assembly. In an effort to avoid this objectionable closing noise and minimize long-term handle assembly damage, cushioning members have been provided in the door handle assembly which protectively intercept the closing movement of the door handle and cushion the closing movement. However, prior art cushioning member designs, while effective to minimize or reduce the objectionable slapping noise, also introduce the potential for leakage of air, water and other contaminants into the interior of the vehicle door through the door handle assembly with resultant potential for corrosion and material deterioration.

SUMMARY OF THE INVENTION

This is invention is directed to the provision of an improved motor vehicle door handle assembly.

More particularly, this invention is directed to the provision of a motor vehicle door handle assembly in which the movement of the door handle to its closed position is effectively cushioned and in which an effective water and contaminant seal is maintained at the door handle assembly.

The door handle assembly of the invention is intended for use with a vehicle including a door and a latch assembly mounted on the door and controlled by the door handle assembly. The door handle assembly includes a housing adapted to be positioned in the door and a handle mounted on the housing for movement between open and closed positions.

According to the invention, the housing defines an opening and an annular surface in surrounding relation to the opening; the handle includes a main body grip portion, an arm portion extending inwardly from the grip portion and passing through the opening in the housing for coaction with a latch release mechanism positioned in the door, and an annular handle surface on the grip portion in surrounding relation to the arm portion; and the door handle assembly includes an annular resilient member positioned in surrounding relation to the arm portion and including an annular main body portion defining a generally planar annular surface, a series of spaced cushion portions projecting from the annular resilient member surface and movable into cushioning coaction with one of the annular housing surface and the annular handle surface to cushion the movement of the handle to its closed position, and an annular peripheral seal portion projecting from the resilient member annular surface in surrounding relation to the cushion portions and movable into sealing coaction with the one annular surface to preclude the entry of moisture and contaminants into the interior of the door with the handle in its closed position. This arrangement allows a single, simple resilient member to serve both a cushioning and sealing function with respect to the door handle assembly.

According to a further feature of the invention, the planar annular surface of the main body portion of the resilient member is an inner surface; the cushion portions and the seal portion of the resilient member project inwardly from the inner planar annular surface of the resilient member; the resilient member is mounted on the arm portion with an outer surface of the main body portion mounted against the annular handle surface; and the cushion portions and the seal portion of the resilient member coact with the annular housing surface. This specific arrangement, whereby the resilient member is mounted on and moves with the handle member, provides an efficient means of providing the desired cushioning and sealing functions.

According to a further feature of the invention, the cushion portions project inwardly from the forward annular surface of the resilient member further than the peripheral seal portion projects so that the initial contact between the resilient member and the housing annular surface as the handle moves to its closed position is the cushioning impact of the cushion portions against the annular housing surface whereafter, with resilient distortion and flattening of the cushion portions, the peripheral seal portion may move into sealing engagement with the housing annular surface. This arrangement ensures that the initial contact will provide the desired cushioning action and the subsequent contact will provide the desired sealing action. According to a further feature of the invention, the handle assembly further includes a spring biasing the handle toward its closed position and the spring is operative with the handle its closed position to maintain the cushion portions in a distorted, flattened configuration so as to allow the peripheral seal portion to sealingly engage the housing annular surface. The spring member already present in the typical door handle assembly thereby provides initial cushioning movement of the resilient member against the annular housing surface and thereafter maintains the cushion portions of the resilient member in a distorted, flattened configuration to allow the peripheral seal portion to sealingly engage the housing annular surface.

According to a further feature of the invention, the handle is pivotally mounted to the housing proximate one end of the grip portion and the arm portion extends forwardly from another end of the grip portion for passage through the opening in the housing. This construction allows the cushioning and sealing member of the invention to be readily employed with a typical grip-type door handle assembly.

According to a further feature of the invention, the housing defines an outwardly opening cavity proximate the housing opening; the housing opening and the housing annular surface are defined at the bottom of the cavity; and the other end of the handle grip portion is configured to be received in the cavity with the handle in its closed position so that an outer face of the handle grip portion may be substantially flush with an outer face of the housing with the handle in its closed position. This arrangement allows the handle to assume a flush configuration with respect to the housing with the handle in its closed position.

According to a further feature of the invention, each cushion portion has a domed configuration in cross section and the seal portion has a knife edge configuration in cross section. This specific cross-sectional configuration of the cushion and the seal portion allows the cushion portions to provide an effective cushioning action while allowing the seal portion to provide an effective sealing action.

According to a further feature of the invention, the door handle assembly is an outside door handle assembly. Whereas the invention has applicability to both inside and outside motor vehicle door handle assemblies, the invention is particularly effective with respect to an outside door handle assembly where the cushioning and sealing problems are more acute.

BRIEF DESCRIPTION OF THE DRAWINGS

FIG. 4 is a cross-sectional view taken on line 4—4 of FIG. 3;

FIG. 5 is a detail view taken within the circle 5 of FIG. 4;

FIGS. 6 and 7 are detail views of a resilient cushioning and sealing member employed in the invention door handle assembly;

DESCRIPTION OF THE PREFERRED EMBODIMENT

Figure 1:
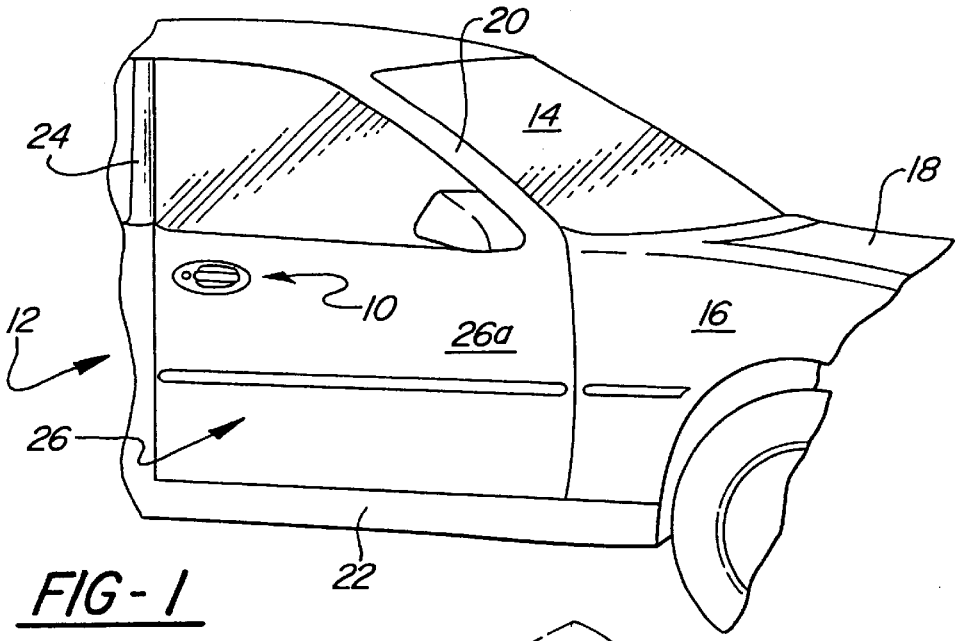
FIG. 1 is a fragmentary, perspective view of a motor vehicle including a door embodying the door handle assembly of the invention.
Figure 2:
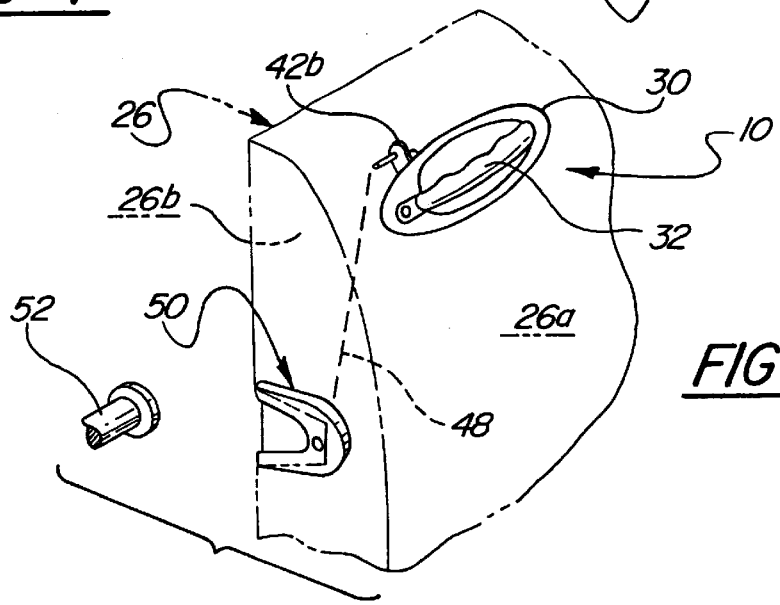
FIG. 2 is a perspective, fragmentary view of the door seen in FIG. 1.

The invention door handle assembly 10 is seen in FIG. 1 in association with a fragmentarily shown motor vehicle 12 including a windshield 14, a front quarter panel 16, a hood 18, an A pillar 20, a sill 22, a B pillar 24, and a door 26 positioned in the door opening defined by A pillar 20, front quarter panel 16, sill 22, and B pillar 24.

Figure 3:
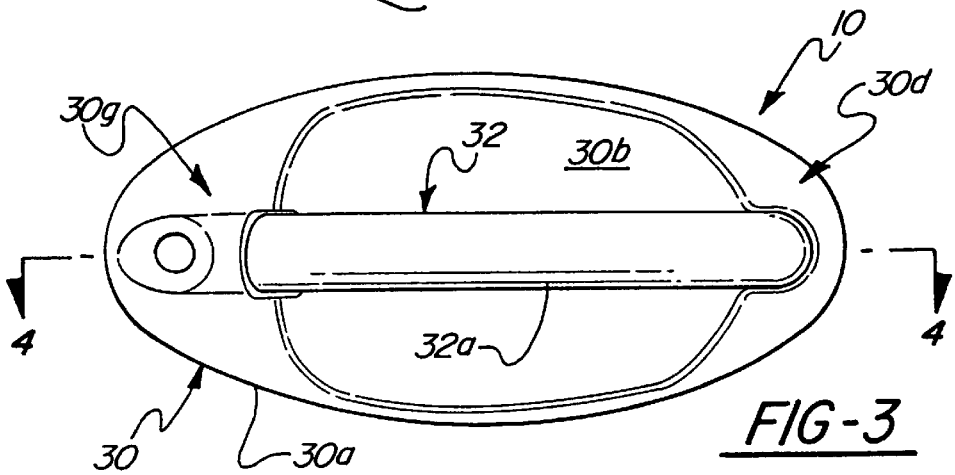
FIG. 3 is a side elevational view of the invention door handle assembly.
Figure 7:
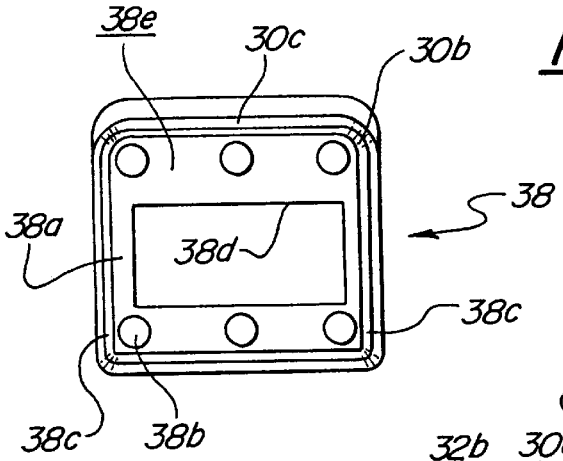
Figure 8:
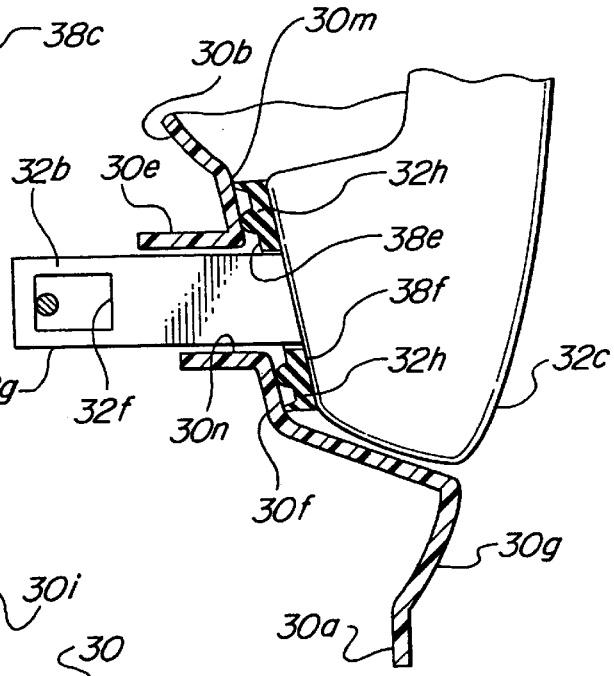
FIG. 8 is a detail view illustrating the cushioning and sealing action of the resilient member.
Figure 11:
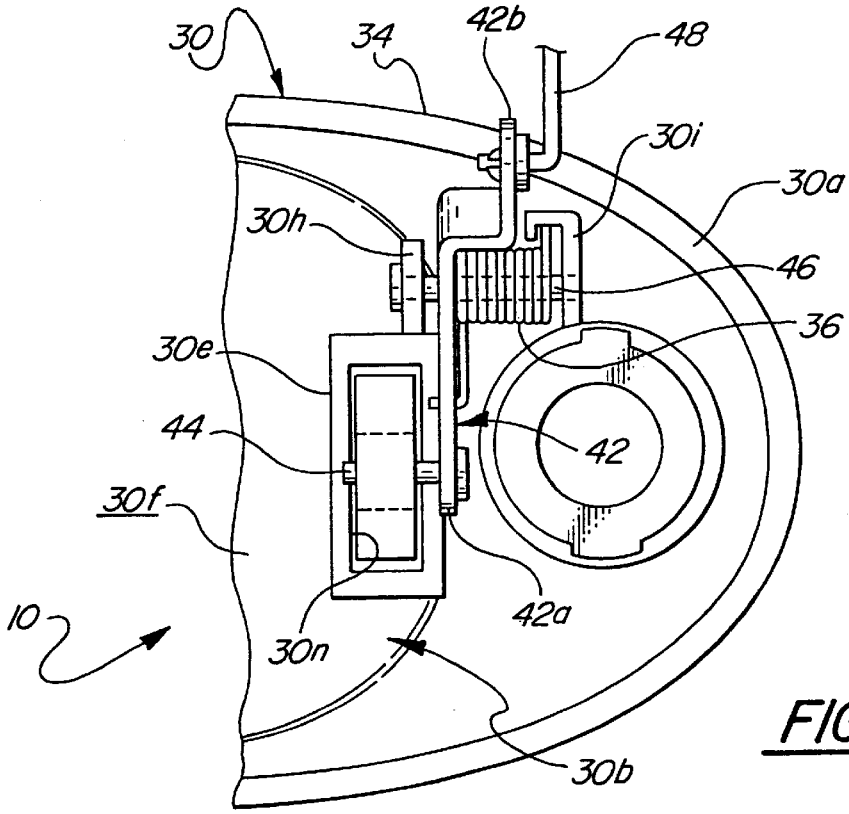
FIG. 11 is a fragmentary rear view of the housing member.

Door handle assembly 10 (FIGS. 3, 4, and 11) includes escutcheon or housing 30, a handle 32, a bell crank assembly 34, a spring 36, and a resilient member 38.

Figure 9:
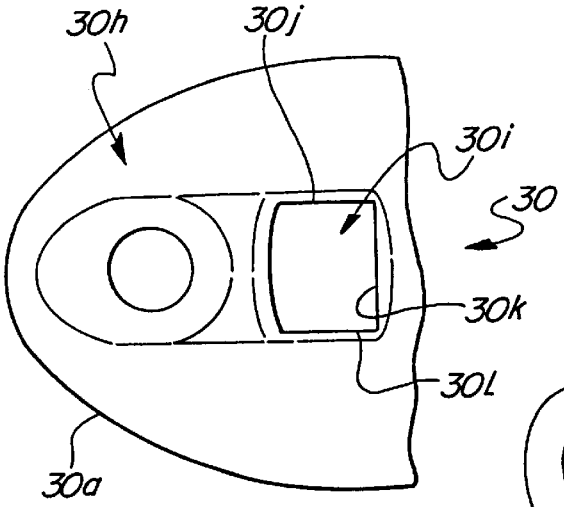
FIGS. 9 and 10 are fragmentary views showing detailed aspects of the housing member of the door handle assembly.
Figure 10:
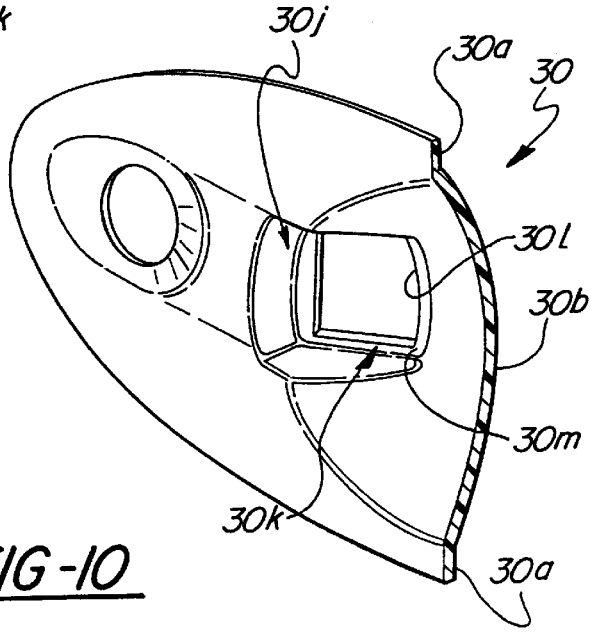

Housing 30 may be formed of a suitable plastic or metallic material and has a generally oval configuration sized to fit into a suitable opening in the outer skin 26*a* of door 26 utilizing fastener means, not shown. Housing 30 includes a peripheral flange portion 30*a* positioned against the periphery of the opening in the outer door skin 26*a*, a central bowl portion 30*b*, a pivot housing portion 30*c* proximate the rear end 30*d* of the housing, a rectangular tubular guide portion 30*e* projecting inwardly from an inner face 30*f* of the housing proximate the front end 30*g* of the housing, and pillars 30*h* and 30*i* projecting inwardly in spaced relation from the inner face 30*f* of the housing proximate guide portion 30*e*. The outer face of the housing (FIGS. 9 and 10) is configured proximate housing front end 30*g* to define an outwardly opening cavity 30*j* having a bottom face 30*k*. A rectangular opening 30*l* is defined in bottom face 30*k* and an annular housing surface 30*m* is defined in bottom face 30*k* in surrounding relation to opening 30*l*. Rectangular opening 30*l* is aligned with and is coextensive with the rectangular central passage 30*n* of rectangular guide portion 30*e*.

Figure 12:
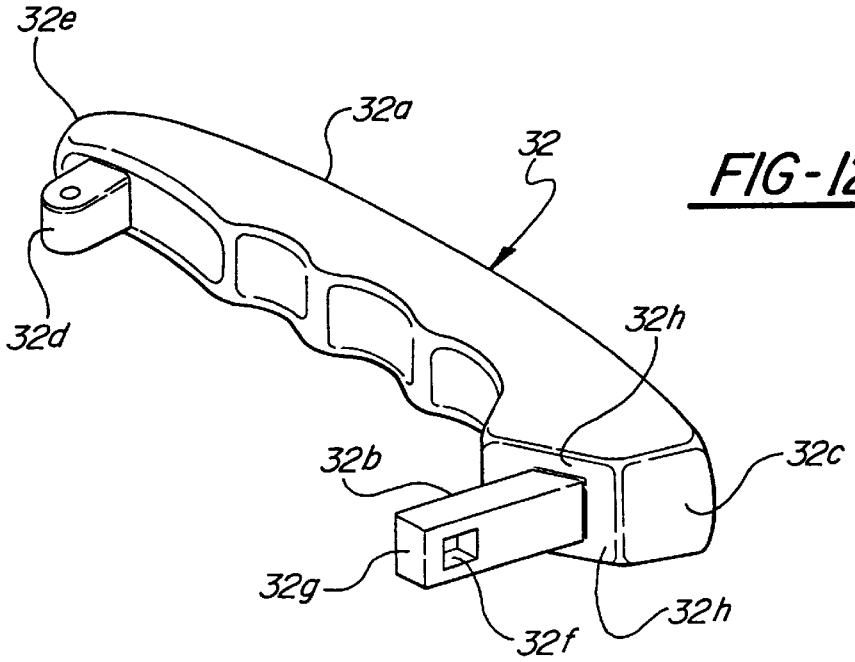
FIG. 12 is a perspective view of the handle utilized in the invention door handle assembly.

Handle 32 (FIGS. 3, 4, and 12) may be formed of a suitable plastic or metallic material. Handle 32 includes a main body elongated grip portion 32*a*, an arm or finger portion 32*b* projecting inwardly from grip portion 32*a* proximate the forward end 32*c* of the grip portion, and a pivot portion 32*d* projecting inwardly from grip portion 32*a* proximate the rearward end 32*e* of the grip portion. Arm portion 32*b* has a rectangular configuration in cross section sized to pass slidably through rectangular housing opening 30*l* and rectangular housing passage 30*n*; defines a rectangular opening 32*f* proximate the inner end 32*g* of the arm portion; and coacts at a juncture with the inner face of the forward end 32*c* of the grip portion to define an annular housing surface 32*h* in surrounding relation to the arm portion.

Handle 32 is positioned in overlying relation to housing bowl portion 30*b* with handle pivot portion 32*d* received in housing pivot portion 30*c*, the forward end 32*c* of the grip portion of the handle received in cavity 30*j* of the housing, and arm portion 32*b* projecting inwardly from the grip portion and passing through housing opening 30*l* and through passage 30*n* of guide portion 30*e* to position the inner end 32*g* of the arm portion inwardly of the inner end of the guide portion 30*e* and within the interior of the door 26. A pivot pin 40 mounts the forward end 32*e* of the grip portion 32*a* of the handle for pivotal movement relative to the housing about the axis of pivot pin 40 so that the handle may be moved pivotally between the solid line, closed position seen in FIG. 4 to the dash line open position seen in FIG. 4. As the handle moves from its solid line closed position to its dash line open position, arm portion 32*b* moves outwardly within and is guided by housing guide portion 30*e*. The front end 32*c* of the handle has a cross-sectional configuration sized to fit within outwardly opening handle cavity 30*j* so that, as the handle moves to its closed position, handle end 32*c* may seat within cavity 30*j* so than an outer face of the handle grip portion may be substantially flush with the adjacent outer face of the housing.

Bell crank assembly 34 (FIGS. 4 and 11) includes a bell crank 42, a guide pin 44, and a pivot pin 46. Guide pin 44 is mounted on an end 42*a* of bell crank 44 and is received in opening 32*f* in the arm portion 32*b* of the handle. Pivot pin 46 is mounted at its opposite ends in housing pillars 30*h* and 30*i* and is fixedly secured to a central portion of bell crank 42. The free end 42*b* of bell crank 42 is adapted to be secured to a suitable link or cable 48 which is connected in known manner to a latch assembly 50 positioned on the shut face 26*b* of the door for coaction in known manner with a bolt or striker 52 provided on the B pillar 24 of the vehicle. It will be understood that movement of the handle 32 between its closed and open positions pivots bell crank lever 42 in a manner such that cable or link 48 is operative to move latch 50 between latched and unlatched positions in known manner.

Spring 36 comprises a coil spring and is positioned concentrically around pivot shaft 46 between bell crank 42 and pillar 30*i*. Spring 36 is anchored at its opposite ends to the housing and to the bell crank whereby to act in known manner to resiliently resist opening movement of the handle and move the handle in a firm positive manner to its closed position upon release of the handle.

Resilient member 38 (FIGS. 5, 6, 7, and 8) has a generally rectangular configuration and is formed of a suitable elastomeric material. Resilient member 38 includes a generally planar annular main body portion 38*a*, a series of cushion portions 38*b*, and a peripheral seal portion 38*c*. Main body portion 38*a* defines a central rectangular aperture 38*d*, a generally planar annular inner face 38*e*, and a generally planar annular outer face 38*f*. Cushion portions 38*b* have a domed cross-sectional configuration and project inwardly from the inner annular surface 38*e* of the resilient member, and peripheral seal portion 38*c* has a knife edge crosssectional configuration and projects inwardly from annular surface 38*e* in surrounding relation to the cushion portions. In the relaxed configuration of resilient member 38, cushion portions 38*b* project inwardly from surface 38*e* by a distance slightly in excess of the distance by which the peripheral seal 38*c* projects inwardly from portion 38*e*.

Resilient member 38 is positioned on handle arm portion 38*b* at the juncture between arm portion 38*b* and the forward end 32*c* of the handle with the rear annular face 38*f* of the resilient member mounted against the annular handle surface 32*h* and is suitably fixedly secured to surface 32*h*. In operation, as the grip portion 32*a* of the handle is released to allow the handle to move to its closed position, resilient member 38 acts to both cushion the movement of the handle to its closed position to minimize objectionable noise and further acts to provide a seal between the handle member and the housing to preclude the entry of air, water or other contaminants into the interior of the door. Specifically, as the handle moves to its closed position, the tips of the cushion portions 38*b* engage housing annular surface 30*m* to cushion the impact of the handle against the housing and minimize objectionable noise whereafter, following distortion or flattening of the domed cushion members, the knife edge of the peripheral seal portion 38*c* moves into sealing engagement with housing annular surface 30*m* in surrounding relation to the cushion members to preclude the entry of contaminants into the interior of the door handle in its closed position. Spring 36 acts to move the handle firmly and positively to its closed position and further acts to maintain the domed cushion portions in a slightly compressed configuration whereby to allow the knife edges of the peripheral seal to maintain sealing engagement with the annular housing portion surface 30*m*.

The door handle assembly of the invention will be seen to provide an improved construction wherein the noise associated with the movement of the handle to its closed position is effectively muzzled and wherein effective sealing is provided between the door handle and the housing to minimize the entry of contaminants into the interior of the door with the handle in its closed position.

Whereas a preferred embodiment of the invention has been illustrated and described in detail, it will be apparent that various changes may be made into this disclosed embodiment without departing from the scope or spirit of the invention.

What is claimed is:

1. A door handle assembly for use with a vehicle including a door and a latch assembly mounted on the door and controlled by the door handle assembly, the assembly including:

a housing adapted to be positioned in the door and defining an opening and an annular surface in surrounding relation to the opening;

a handle mounted on the housing for movement between open and closed positions and including a main body grip portion, and an arm portion extending inwardly from the grip portion and passing inwardly through the opening in the housing for coaction with a latch release mechanism positioned within the door;

an annular handle surface on the grip portion in surrounding relation to the arm portion and in confronting relation to the housing annular surface; and an annular resilient member positioned in surrounding relation to the arm portion between the handle annular surface and the housing annular surface and including an annular main body portion defining a generally planar annular surface positioned in confronting relation to one of said annular handle surface and said annular housing surface, a series of spaced cushion portions projecting from the resilient member annular surface and movable into cushioning coaction with said one annular surface to cushion the movement of the handle to its closed position, and an annular peripheral seal portion projecting from the resilient member annular surface in surrounding relation to the cushion portions and movable into sealing coaction with said one annular surface to preclude the entry of moisture and contaminants into the interior of the door with the handle in its closed position.

2. A handle assembly according to claim 1 wherein each cushion portion has a domed configuration in cross section and the seal portion has a knife edge configuration in cross section.

3. A door handle assembly according to claim 1 wherein the handle assembly is an outside door handle assembly.

4. A door handle assembly for use with a vehicle including a door and a latch assembly mounted on the door and controlled by the door handle assembly, the assembly including:

a housing adapted to be positioned in the door and defining an opening and an annular surface in surrounding relation to the opening;

a handle mounted on the housing for movement between open and closed positions and including a main body grip portion, and an arm portion extending inwardly from the grip portion and passing inwardly through the opening in the housing for coaction with a latch release mechanism positioned within the door;

an annular handle surface on the grip portion in surrounding relation to the arm portion;

an annular resilient member positioned in surrounding relation to the arm portion and including an annular main body portion defining a generally planar annular surface, a series of spaced cushion portions projecting from the resilient member annular surface and movable into cushioning coaction with one of said annular housing surface and said annular handle surface to cushion the movement of the handle to its closed position, and an annular peripheral seal portion projecting from the resilient member annular surface in surrounding relation to the cushion portions and movable into sealing coaction with said one annular surface to preclude the entry of moisture and contaminants into the interior of the dooirwith the handle in its closed position;

the planar annular surface of the main body portion of the resilient member comprising an inner surface;

the cushion portions and the seal portion projecting inwardly from the inner planar annular surface of the resilient member;

the resilient member being mounted on the arm portion with an outer surface of the main body portion mounted against the annular handle surface; and the cushion portions and seal portions of the resilient member coacting with the annular housing surface.

5. A door handle assembly according to claim 4 wherein the cushion portions project inwardly from the inner annular surface further than the peripheral seal portion projects so that the initial contact between the resilient member and the housing annular surface as the handle moves to its closed position is cushioning impact of the cushion portions against the annular housing surface whereafter, with resilient distortion and flattening of the cushion portions, the peripheral seal portion may move into sealing engagement with the housing annual surface.

6. A door handle assembly according to claim 5 wherein:

the handle assembly further includes a spring biasing the handle toward its closed position; and the spring is operative with the handle in its closed position to maintain the cushion portions in a distorted, flattened configuration so as to allow the peripheral seal portion to sealingly engage the housing annular surface.

7. A door handle assembly according to claim 5 wherein:

the handle is pivotally mounted to the housing proximate one end of the grip portion; and the arm portion extends inwardly from another end of the grip portion for passage through the opening in the housing.

8. A door handle assembly according to claim 7 wherein:

the housing defines an outwardly opening cavity proximate the housing opening;

the housing opening and the housing annular surface are defined in the bottom of the cavity; and the other end of the handle grip portion is configured to be received in the cavity with the handle in its closed position so that an outer face of the handle grip portion may be substantially flush with an outer face of the housing with the handle in its closed position.

9. A door handle assembly for use with a vehicle including a door handle and a latch assembly mounted on the door and controlled by the door handle assembly, the door handle assembly including a housing adapted to be positioned in the door and a handle mounted on the housing for movement between open and closed positions, characterized in that:

the handle includes a main body grip portion and an arm portion extending inwardly from the grip portion;

the housing defines an opening and an annular surface in surrounding relation to the opening;

the handle arm portion passes inwardly through the handle opening for coaction with a latch release mechanism positioned within the door; and the housing further includes an annular resilient member mounted on and in surrounding relation to the arm portion and including an annular main body portion defining a generally planar annular inner surface, a plurality of cushion portions projecting inwardly from the planar annular surface and movable into cushioning coaction with the annular housing surface to cushion the movement of the handle to its closed position, and an annular peripheral seal portion projecting inwardly from the planar annular surface in surrounding relation to the cushion portions and movable igto sealing coaction with the annular housing surface to preclude the entry of moisture and contaminants into the interior of the door with the handle in its closed position.

10. A door handle assembly according to claim 9 wherein, the cushion portions project inwardly from the inner annular surface further than the peripheral seal portion projects so that the initial contact between the annular member and the housing annular surface as the handle moves to its closed position is cushioning impact of the cushion portions against the annular housing surface whereafter, with resilient distortion and flattening of the cushion portions, the peripheral seal portion may be move into sealing engagement with the housing annular surface.

11. A door handle assembly according to claim 10 wherein:

the handle assembly further includes a spring biasing the handle toward its closed position; and the spring is operative with the handle in its closed position to maintain the cushion portions in a distorted, flattened configuration so as to allow the peripheral seal portion to sealingly engage the housing annular surface.

12. A door handle assembly according to claim 10 wherein:

the handle is pivotally mounted to the housing proximate one end of the grip portion; and the arm portion extends inwardly from another end of the grip portion for passage through the opening in the housing.

13. A door handle assembly according to claim 12 wherein:

the housing defines an outwardly opening cavity proximate the handle opening;

the handle opening and the handle annular surface are defined in the bottom of the cavity; and the other end of the handle grip portion is configured to be received in the cavity with the handle in its closed position so that an outer face of the handle grip portion may be substantially flush with an outer face of the housing with the handle in its closed position.

14. A door handle assembly according to claim 9 wherein each cushion portion has a domed configuration in cross section and the seal portion has a knife edge configuration in cross section.

15. A door handle assembly according to claim 9 wherein the door handle assembly is an outside door handle assembly.

16. A door handle assembly for use with a vehicle including a door and a latch assembly mounted on the door and controlled by the door handle assembly, the assembly including:

a housing adapted to be positioned in the door and defining an opening and an annular surface in surrounding relation to the opening;

a handle mounted on the housing for movement between open and closed positions and including a main body grip portion, and an arm portion extending inwardly from the grip portion and passing inwardly through the opening in the housing for coaction with a latch release mechanism positioned within the door;

an annular handle surface on the grip portion in surrounding relation to the arm portion;

an annular resilient member positioned in surrounding relation to the arm portion and including an annular main body portion defining a generally planar annular surface, a series of spaced cushion portions projecting from the resilient member annular surface and movable into cushioning coaction with one of said annular housing surface and said annular handle surface to cushion the movement of the handle to its closed position, and an annular peripheral seal portion projecting from the resilient member annular surface in surrounding relation to the cushion portions and movable into sealing coaction with said one annular surface to preclude the entry of moisture and contaminants into the interior of the door with the handle in its closed position;

the annular resilient member being positioned on the arm portion at a juncture between the grip portion and the arm portion with an outer surface of the main body portion of the resilient member mounted against the grip portion.

* * * * *